US010717506B2

(12) United States Patent
Godoy

(10) Patent No.: US 10,717,506 B2
(45) Date of Patent: Jul. 21, 2020

(54) ANTI-FOG DIVING MASK

(71) Applicant: CRESSI-SUB S.P.A., Genoa (IT)

(72) Inventor: Carlos Alberto Godoy, Genoa (IT)

(73) Assignee: Cressi-Sub S.P.A., Genoa (IT)

( * ) Notice: Subject to any disclaimer, the term of this patent is extended or adjusted under 35 U.S.C. 154(b) by 181 days.

(21) Appl. No.: 15/593,524

(22) Filed: May 12, 2017

(65) Prior Publication Data

US 2018/0015990 A1 Jan. 18, 2018

(30) Foreign Application Priority Data

Jul. 15, 2016 (IT) ..... 102016000074067

(51) Int. Cl.
*B63C 11/12* (2006.01)

(52) U.S. Cl.
CPC ..... *B63C 11/12* (2013.01)

(58) Field of Classification Search
CPC . A61F 9/02; A61F 9/028; A61F 9/026; A63B 33/002; A63B 33/004; B63C 11/12; B63C 2011/125; G02C 5/12
USPC ..... 2/435, 431, 426, 440, 446; 128/200.29, 128/201.27, 201.18, 201.24
See application file for complete search history.

(56) References Cited

U.S. PATENT DOCUMENTS 2,197,973 A * 4/1940 Everett ..... G02C 5/12 2/13
2,665,686 A * 1/1954 Wood ..... A41D 13/11 128/206.12
3,694,814 A * 10/1972 De Barbieri ..... B63C 11/12 2/428
6,026,518 A * 2/2000 Brown ..... A41D 20/00 2/181.6
D484,171 S * 12/2003 Urabe ..... D16/312
2001/0013346 A1* 8/2001 Lemke ..... B63C 11/16 128/201.11
2007/0095343 A1* 5/2007 Feng ..... B63C 11/12 128/201.18

* cited by examiner

*Primary Examiner* — Khoa D Huynh
*Assistant Examiner* — Aiying Zhao
(74) *Attorney, Agent, or Firm* — Blank Rome LLP

(57) ABSTRACT

The diving mask includes a rigid frame, one or two lenses, and a face mask made of soft and elastically yielding material, the face mask having a front hollow projection for housing the nose of the diver and a rear perimeter profile applicable in an airtight way to the face of the diver so as to delimit an internal space between the mask and the face of the diver, the internal surface of said face mask being equipped with obstructing means obstructing a direct flow towards lenses of the air released from the diver nose.

11 Claims, 7 Drawing Sheets

ANTI-FOG DIVING MASK

CROSS-REFERENCE TO RELATED APPLICATION

This application claims benefit of priority to Italian Patent Application No. 102016000074067, filed Jul. 15, 2016. The entire contents of which are hereby incorporated by reference.

FIELD OF THE INVENTION

The present invention related to a diving mask which provides anti-fog properties with a simple and cheap construction and production method.

BACKGROUND

Diving masks are composed of a pair of lenses (or a single lens) supported by a rigid frame onto whose profile the so-called face mask is fixed, formed by a sort of shroud of soft and elastically yielding material, equipped with openings for the lenses and whose rear profile is applied in an airtight way to the face of the diver thanks to a strap that surrounds the head of the diver.

However, between the face of the diver and the mask, an internal space remains which is increased by a cavity projecting to house the nose of the diver.

Therefore, the eyes and nose of the diver are closed within the mentioned face mask while his/her mouth remains outside the face mask and can be connected to a cylinder through a mouthpiece.

The mask can also be used for free diving.

In either case, although the nose is not used for breathing, it is inevitable that a small amount of damp air leaves the diver's nose and this damp air can cause the lenses to fog up, hence reducing the diver's visual ability.

Various attempts have been made to reduce the onset of lenses fogging up, mainly through special treatments of the internal surface of the lenses, the effect of which is not always long-lasting and satisfactory.

SUMMARY

The technical task of the present invention is to provide a diving mask that prevents such a drawback by eliminating the cause of the fogging up.

Within the context of this technical task, an object of the invention is to provide a diving mask that has anti-fog properties with a simple and cheap construction and production method.

The technical task, as well as these and other objects, are achieved according to the present invention by providing a diving mask comprising a rigid frame, at least one lens, and a face mask made of soft and elastically yielding material fixed to said frame, said face mask having a front hollow projection for housing the nose of the diver and a rear perimeter profile applicable in an airtight way to the face of the diver so as to delimit an internal space between said mask and the face of the diver, characterised in that the internal surface of said face mask is equipped with obstructing means obstructing a direct flow towards said at least one lens of the air released from the diver nose.

Advantageously said obstructing means is interposed between a first zone of said internal space behind said at least one lens and a second zone of said internal space including said front hollow projection for housing the nose.

According to an embodiment of the invention said obstructing means divides said internal space in an airtight way into said first zone behind said at least one lens and said second zone including said front hollow projection for housing the nose. According to this embodiment, a diving mask is provided wherein, inside the face mask, around the cavity projecting to house the nose, obstructing means in form of at least one rib is arranged which rests on the diver's face so as to separate in an airtight way the cavity for housing the nose from the remaining internal volume of the face mask, behind the eyes of the user.

In this way, any damp air leaving the diver's nose cannot reach the internal surface of the lenses fogging them up.

According to another embodiment of the invention said obstructing means does not create an airtight separation between the cavity for housing the nose and the remaining internal volume of the face mask, behind the eyes of the user. In this embodiment obstruction means just channels said air towards a channel surrounding said at least one lens to avoid a direct flow towards said at least one lens of the air released from the diver nose. This way, before reaching said at least one lens, the air traveling along said channel cools down enough to avoid or at least limit fogging up of said at least one lens.

BRIEF DESCRIPTION OF THE DRAWINGS

Further characteristics and advantages will become more apparent from the following detailed description of an embodiment of the diving mask according to the invention, illustrated by way of non-limiting example in the accompanying figures, wherein.

DETAILED DESCRIPTION

Figure 1:
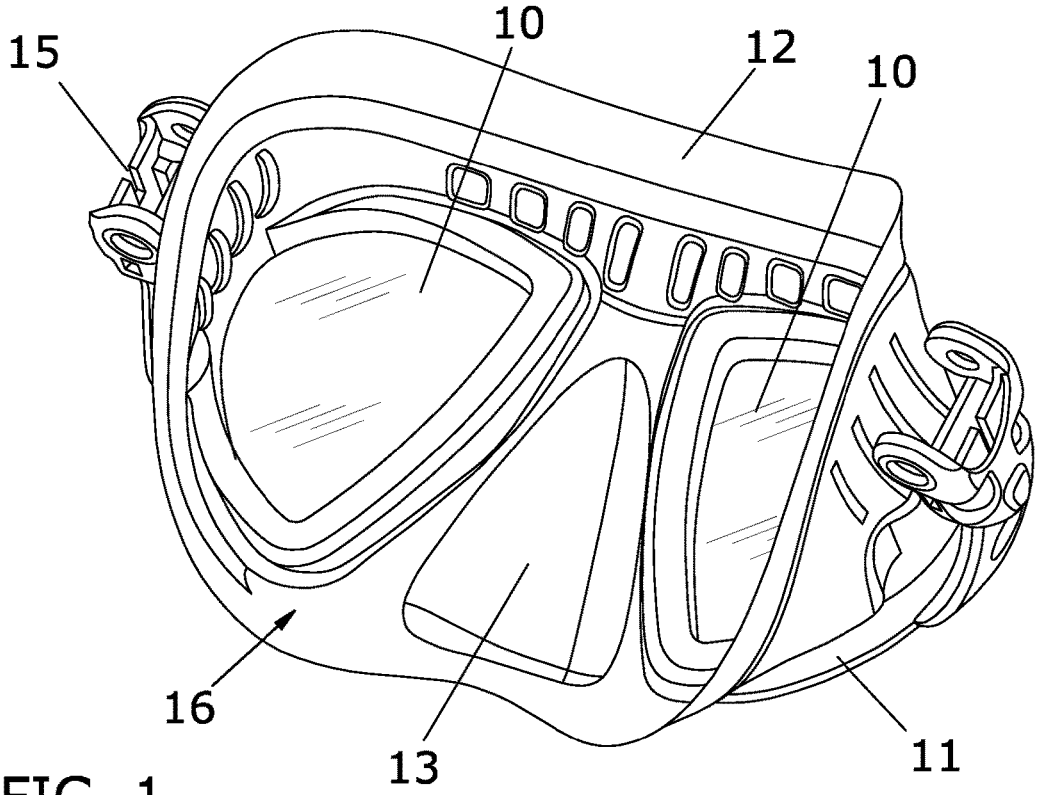
FIG. 1 is the external view of a diving mask of the traditional type.
Figure 2:
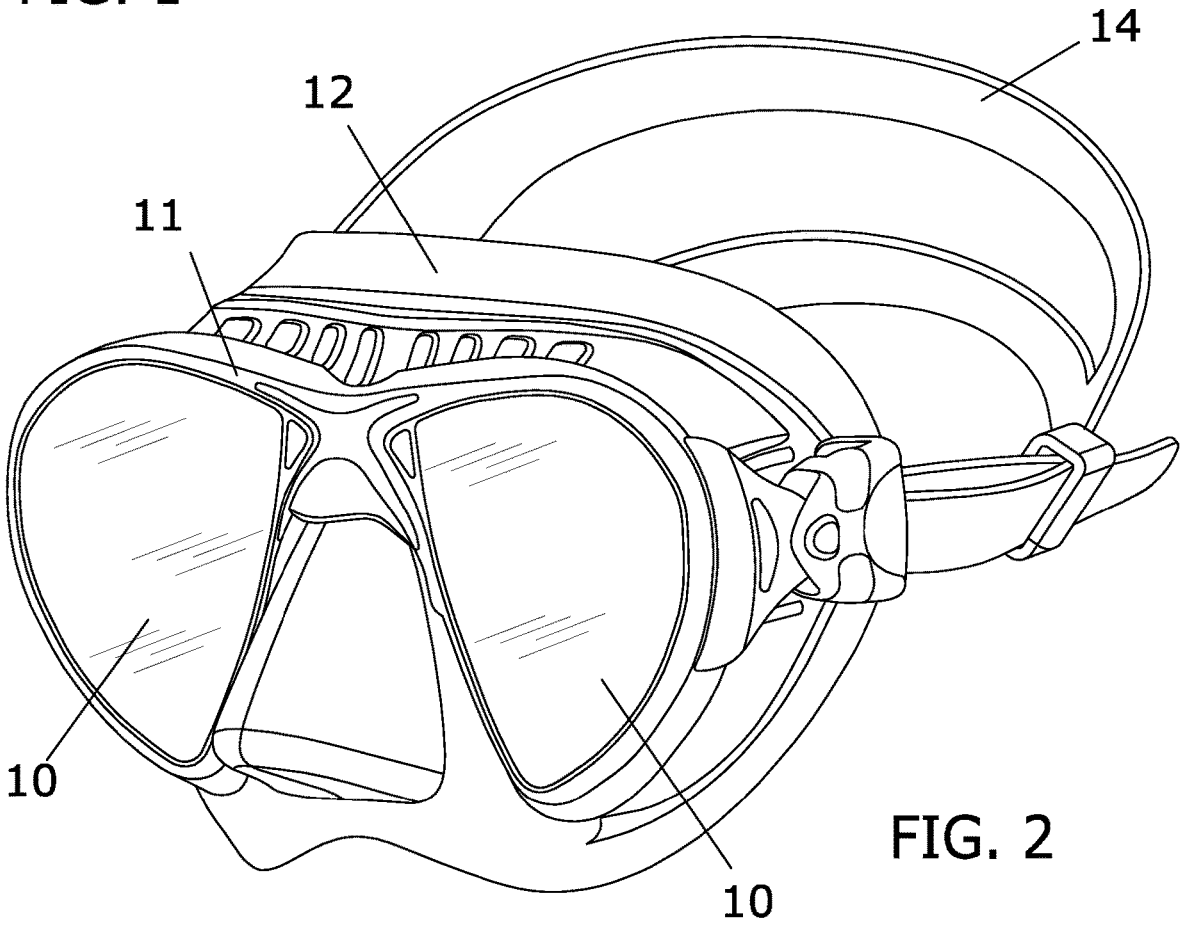
FIG. 2 shows the internal side of the same mask of the traditional type.
Figure 3:
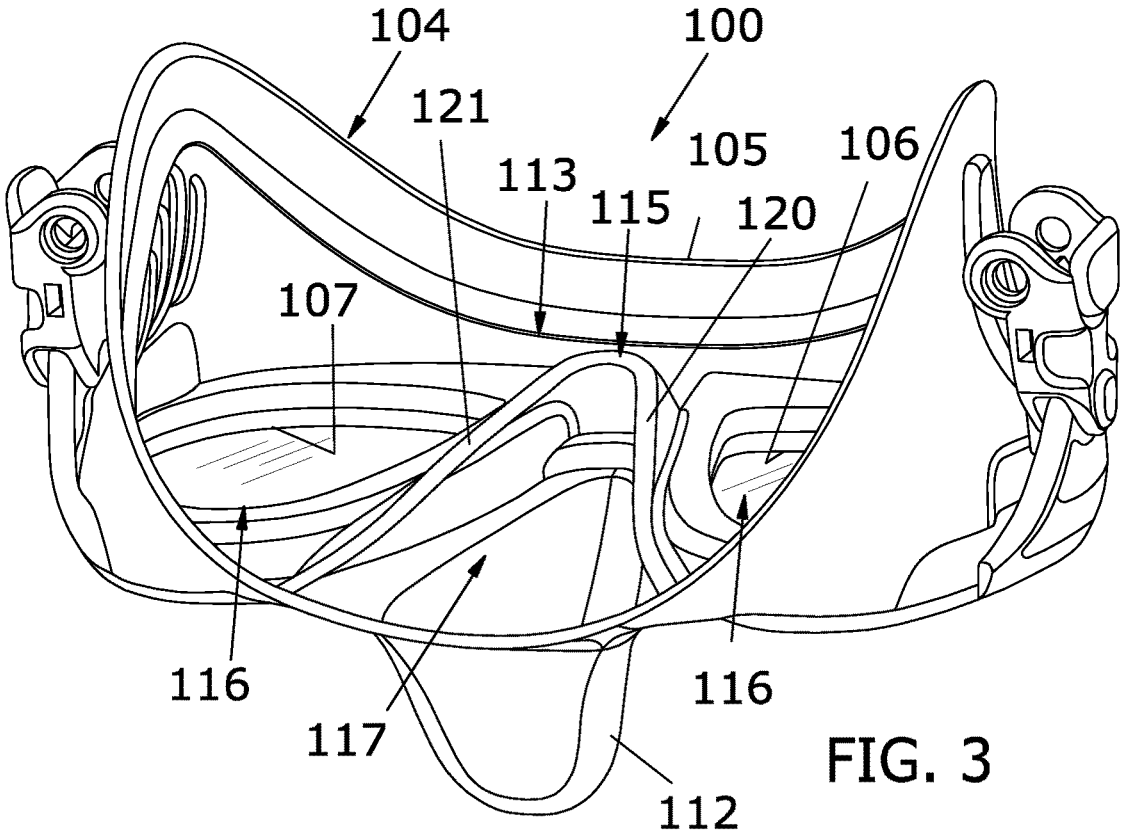
FIG. 3 shows the internal side of a mask according to the present invention.
Figure 6:
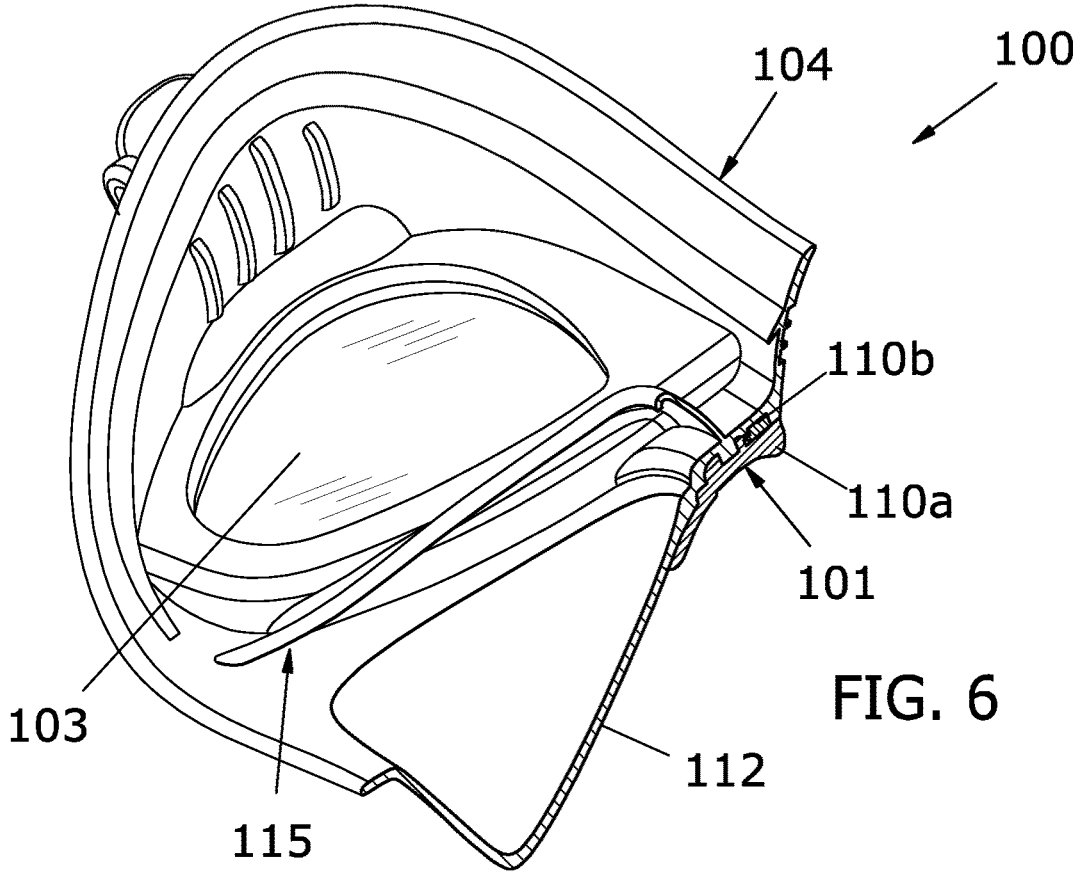
FIG. 6 is a vertical section according to the plane of symmetry of the mask.
Figure 4:
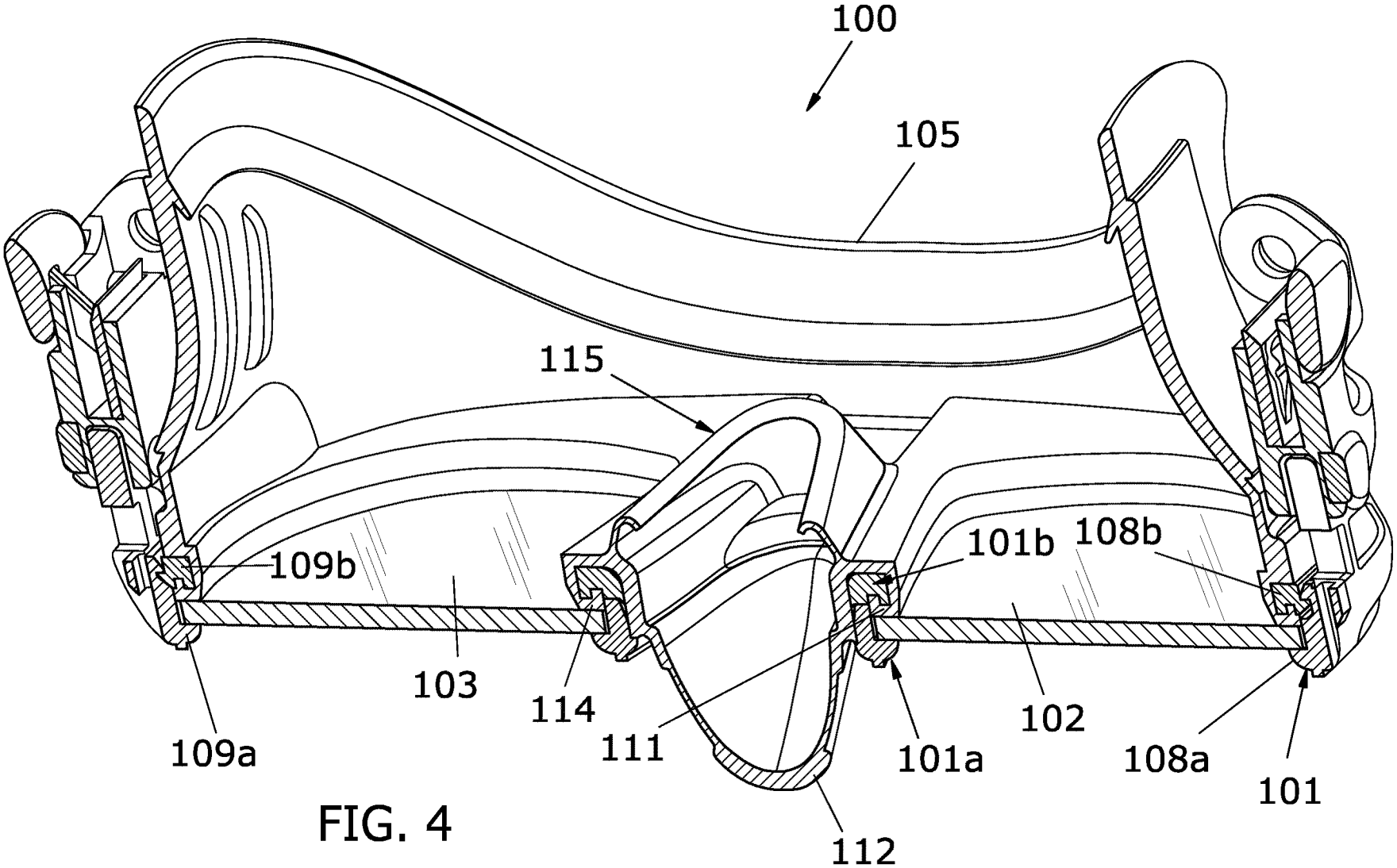
FIG. 4 is the same as the previous one but shows a horizontal section of the mask at the cavity designed to house the nose of the diver.
Figure 5:
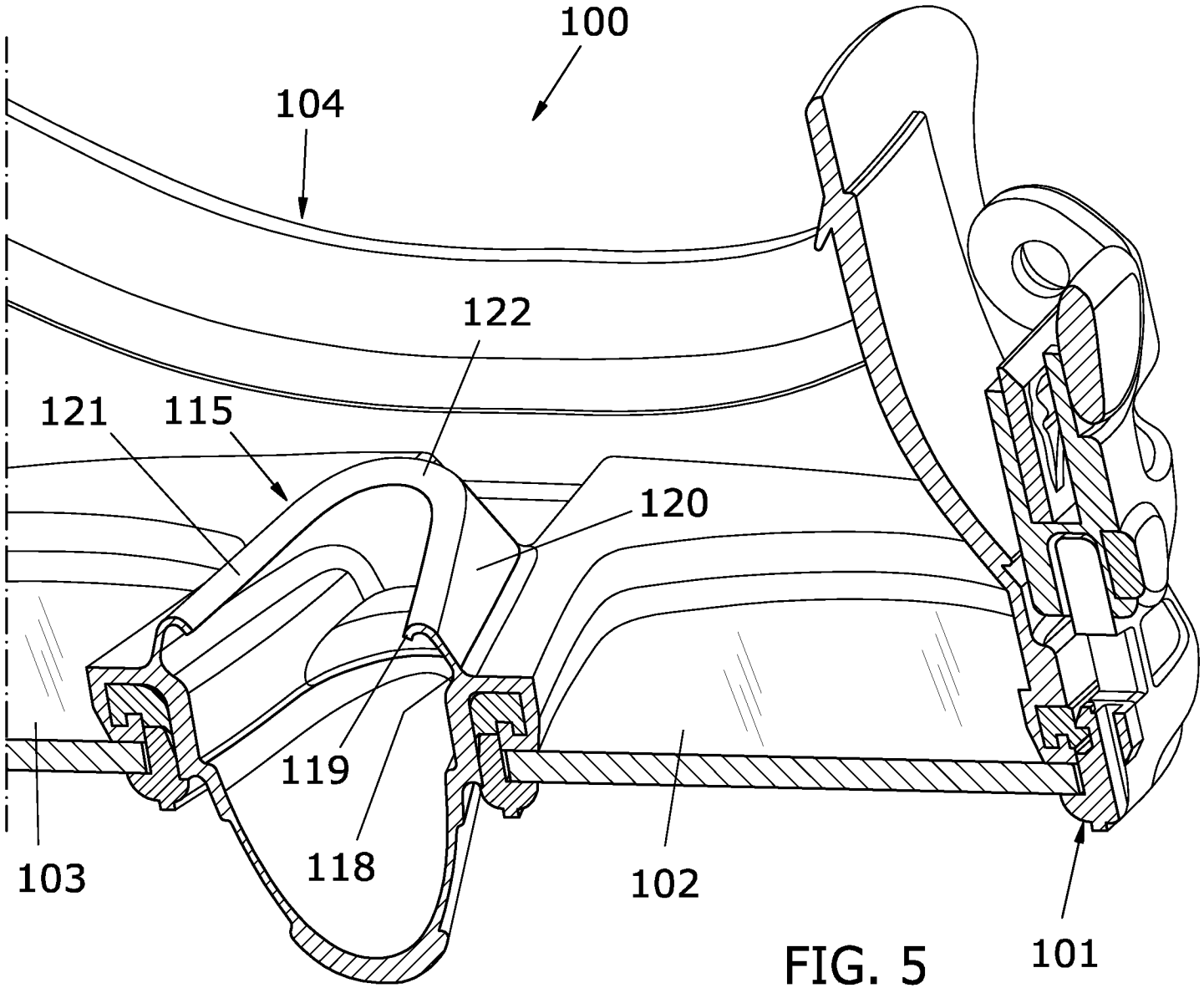
FIG. 5 is an enlarged partial view of FIG. 4.

The traditional mask illustrated in FIGS. 1 and 2 includes a pair of lenses 10, which in one variation may be replaced by a single lens, a rigid frame 11 for supporting the lenses 10, and a face mask 12 made of soft, elastic and yielding material connected in an airtight way to the frame 11, on one side, and adapted to rest, still in an airtight way, against the face of the diver, on the other side.

Such face mask 12 envisages a projecting cavity 13 adapted to house the nose of the diver.

A strap 14 fixed to the two lateral ends of the mask through adjustable buckles 15 of the known type and not shown in detail keeps the mask adhering to the face of the diver.

When the mask is worn, between its internal surface 16 and the face of the user, a single internal space is created.

The small quantities of damp air that can leave the user's nose can therefore be deposited on the internal surface of the lenses 10, fogging them up.

Reference is now made to the solution offered by the present invention illustrated in FIGS. 3-6.

The diving mask 100 comprises a rigid frame 101, a single lens or, as in the illustrated case, a separate right lens 102 and left lens 103, a face mask 104 made of soft and elastically yielding material fixed to the frame 101, and a strap (not shown) to keep the mask 100 on the diver's face.

The face mask 104 has a rear perimeter profile 105 applicable in an airtight way to the face of the diver so as to delimit an internal space 113 between the mask 100 and the face of the diver.

The face mask 104 also has a front hollow projection 112 for housing the nose of the diver, and at the front for each lens 102, 103 a corresponding positioning opening 106, 107.

The frame 101 comprises a front element 101*a* and a rear element 101*b* superimposed and mutually connected so as to ensure the airtightness between the face mask 104 and the lenses 102, 103.

The front element 101*a* and the rear element 101*b* of the frame 101 each have a right annular portion 108*a*, 108*b*, a left annular portion 109*a*, 109*b*, and a central portion 110*a*, 110*b* connecting the right annular portion 108*a*, 108*b* and the left annular portion 109*a*, 109*b*.

The right annular portion 108*a* of the front element 101*a* and the right annular portion 108*b* of the rear element 101*b* of the frame 101 surround and retain the right lens 102, while the left annular portion 109*a* of the front element 101*a* and the left annular portion 109*b* of the rear element 101*b* of the frame 101 surround and retain the left lens 103.

The central connection portion 110*a*, 110*b* is internally lowered with respect to the right annular portion 108*a*, 108*b* and the left annular portion 109*a*, 109*b* so as to leave a suitable distance from the root of the nose.

Each opening 106, 107 of the face mask 104 has along its perimeter edge a hollow flange 111, 114 with a transversal section in the form of a polygonal spiral in which the corresponding annular portion 108*b*, 109*b* of the rear element 101*b* of the frame 101 is engaged.

Obviously, the scope of the present invention also includes a different airtight connection system which does not envisage the flange 111, 114.

Advantageously, the internal surface of the face mask 104 is equipped with obstructing means obstructing a direct flow towards lenses 102, 103 of the air released from the diver nose.

Obstruction means comprises in this embodiment at least one rib 115 which surrounds the front hollow projection 112 for housing the nose.

The rib 115 is configured so as to divide in an airtight way the internal space 113 between the mask 100 and the face of the diver, into a first zone 116 behind the lenses 102, 103 and a second zone 117 including the front hollow projection 112 for housing the nose.

The rib 115 is advantageously made of a single piece with the face mask 104.

The rib 115 has a base end 118 for attachment to the rear surface of the face mask 104 and an apical end 119 advantageously turned back, in particular but not necessarily turned back towards the inside of the second zone 117, so as to create suitable airtight contact with the diver's face.

The rib 115 has a constant thickness and a height, meaning the distance between its base end 118 and its apical end 119, which increases gradually in the direction from the lower edge to the upper edge of the face mask 104.

The rib 115 extends at least in part in a laterally staggered position from the frame 101.

In particular, the rib 115 extends at least in part along the perimeter edge of the front hollow projection 112 for housing the nose.

With reference to the illustrated mask 100 having two separate lenses 102, 103 there is provided a single rib 115 having two converging sections 120, 121 connected by a transversal section 122.

More precisely, the two converging sections 120, 121 of the rib 115, with a substantially flat conformation, extend in a laterally staggered position from the frame 101 along the perimeter edge of the front hollow projection 112 for housing the hose, while the transversal section 122 extends to the rear of the frame 101, and in particular to the rear of the central portion 110*a*, 110*b* of the frame 101.

When the mask 100 is worn, the two converging sections 120, 121 are arranged along the lateral walls of the nose while the transversal section 122 is arranged around the root of the nose.

The first zone 116 of the internal space 113 between the mask 100 and the face of the diver is formed by a single air chamber that extends continuously from the zone behind the right lens 102 to the zone behind the left lens 103 passing through the zone surmounting the transversal section 122 of the rib 115.

Instead of having a single rib 115, in a solution not shown, it is possible to provide two or more distinct and separate ribs, for example two ribs that split in an airtight way the internal space 113 between the mask 100 and the diver's face into a first zone 116 behind the lenses 102, 103 formed by two air chambers isolated from each other and a second zone 117 including the front hollow projection 112 for housing the nose.

Therefore, according to the invention, when the diver wears the mask 100, the rib 115, resting on the user's face, separates the first zone 116 from the second zone 117 of the internal space 113 between the mask 100 and the face.

Any emissions of damp air from the diver's nose cannot come into contact with the rear face of the lens or the lenses and therefore any possibility of fogging up thereof is prevented.

Figure 7:
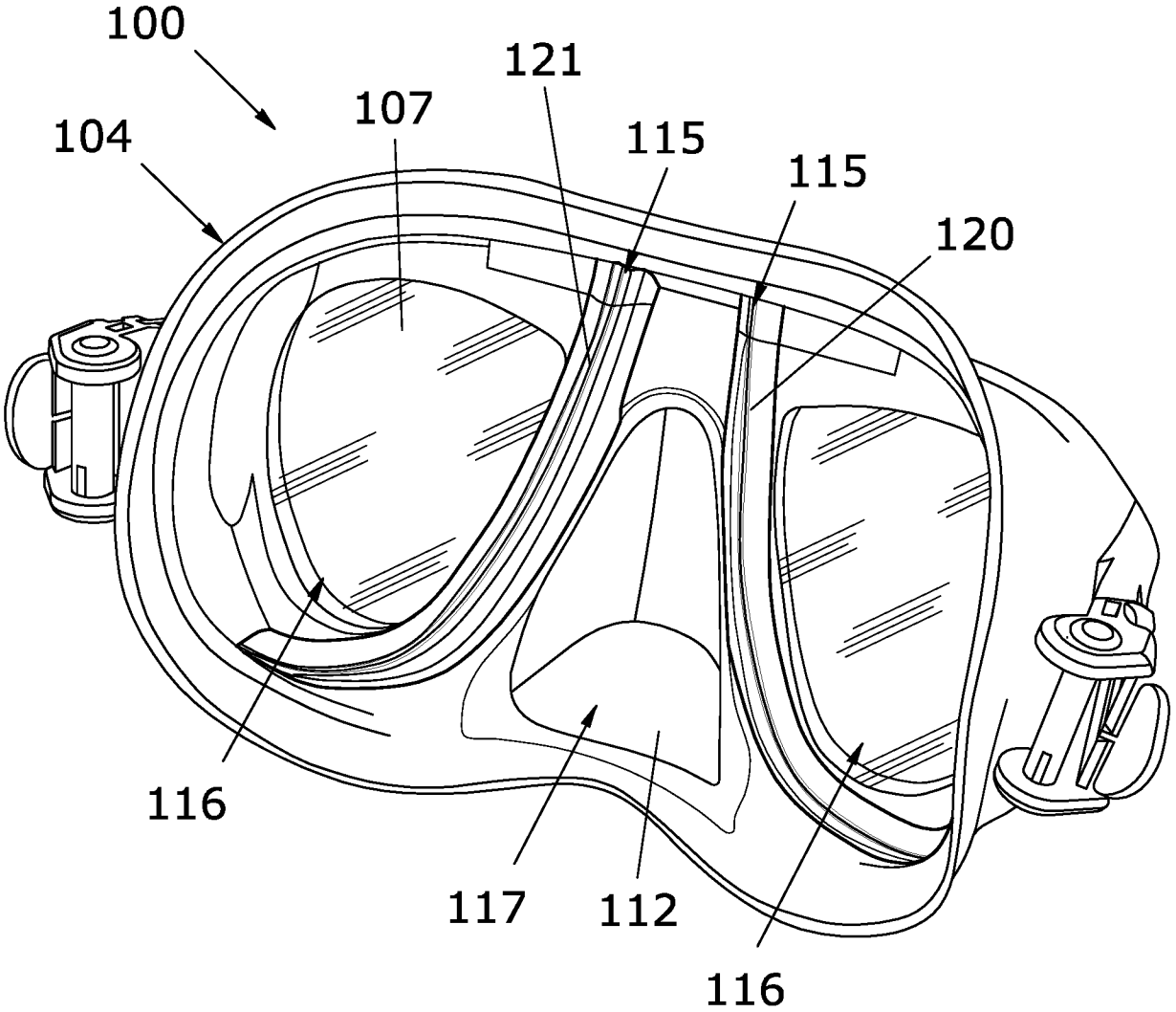
FIG. 7 shows the internal side of a mask according to another embodiment of the invention where obstruction means comprises two ribs.
Figure 8A:
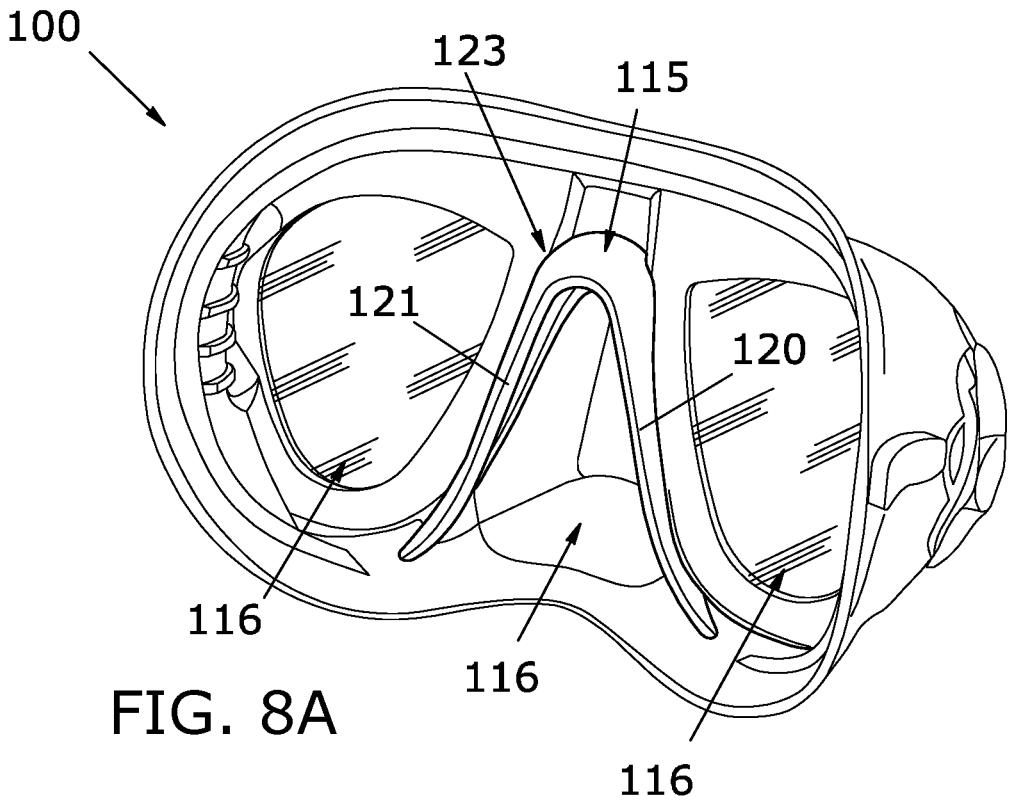
FIG. 8A shows the internal side of a mask according to another embodiment of the invention where obstruction means is made in a piece independent from the face mask.
Figure 8B:
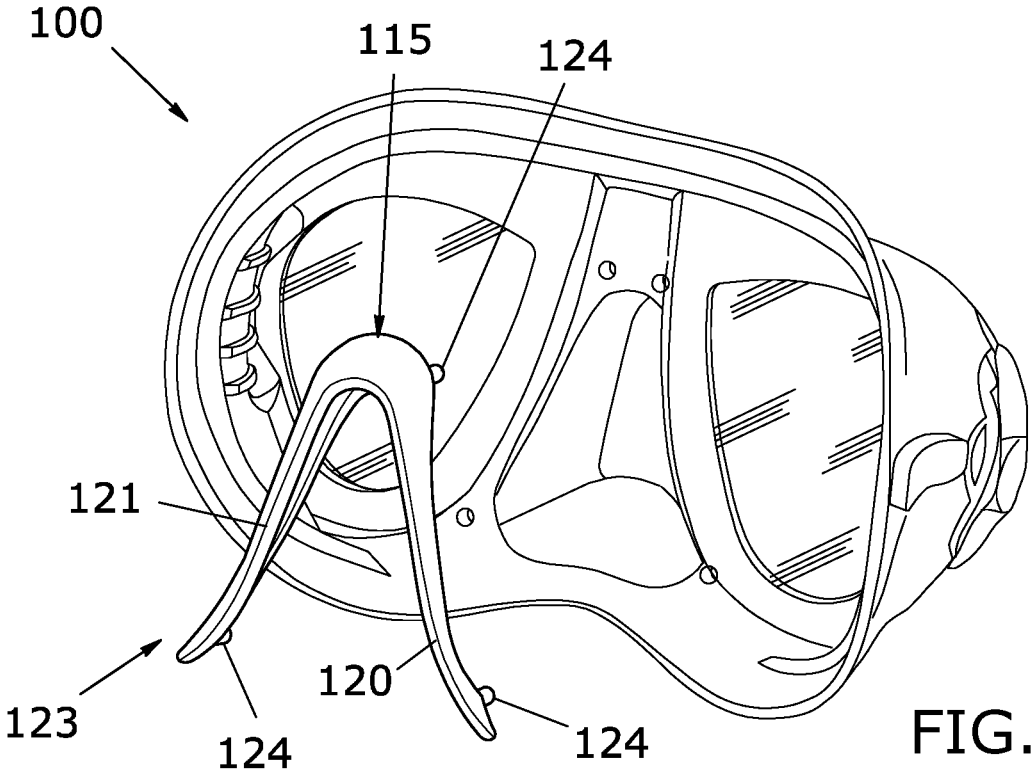
FIG. 8B shows the internal side of a mask according to another embodiment of the invention where obstruction means is made in a piece separated from the face mask.
Figure 9:
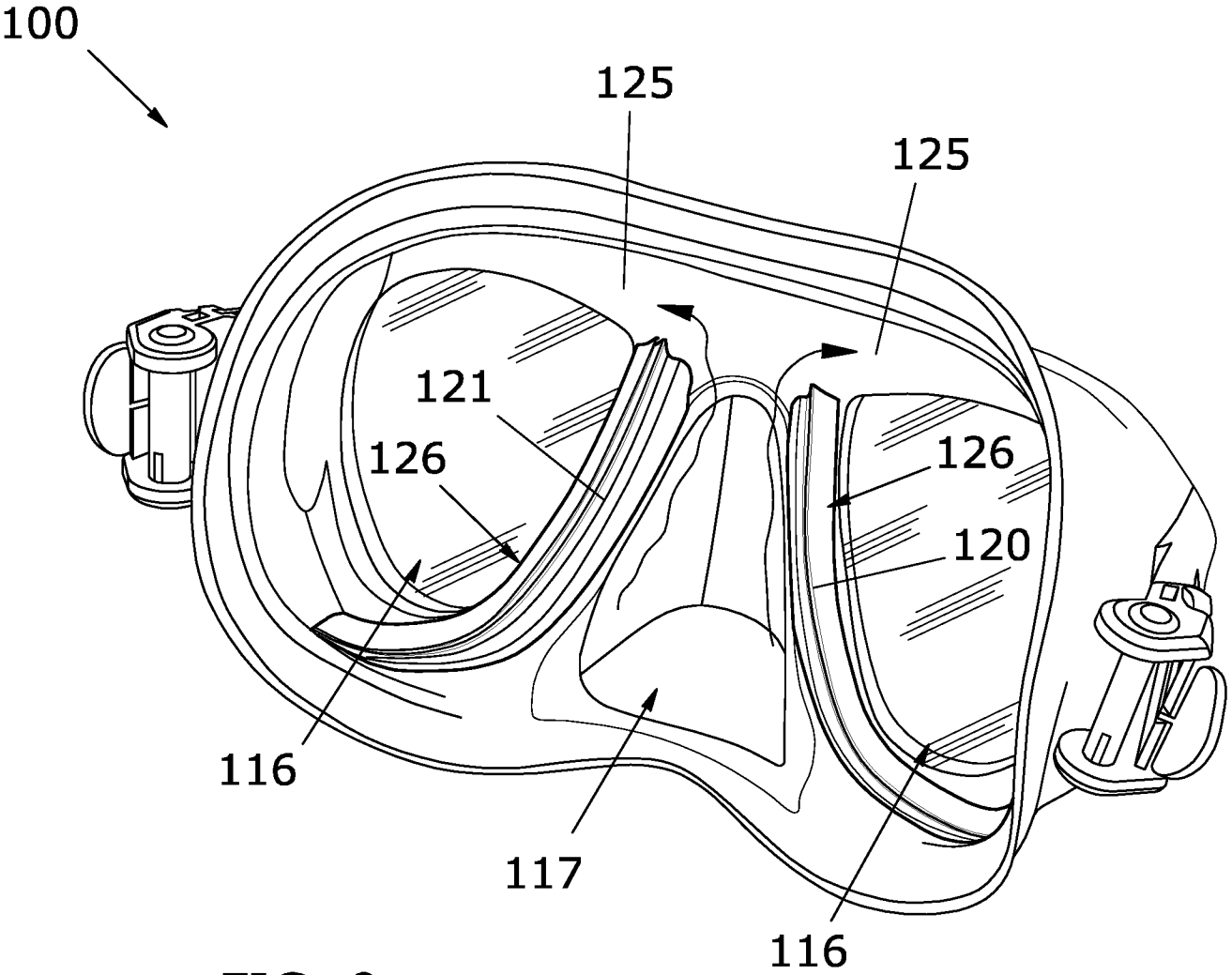
FIG. 9 shows the internal side of a mask according to another embodiment of the invention where obstruction means is made of at least one wing made of soft and elastically yielding material.

With reference to embodiments shown in FIGS. 7 to 9 equivalent parts to embodiment shown in FIGS. 3 to 6 are indicated with same reference numbers.

In FIG. 7 obstruction means comprises two ribs 115 extending along the opposite sides of perimeter edge of the front hollow projection 112 for housing the nose.

In FIGS. 8A and 8B obstruction means is made in a piece 123 independent and separated from the face mask 104.

Piece 123 has a shape matching the shape of the front hollow projection 112 for housing the nose and is attached thereto.

Preferably releaseable connection elements 124 like snap hooking elements are provided between the piece 123 and the front hollow projection 112 so that piece 123 may be provided as an accessory independent and separated from the diving mask 100.

Obstruction means may be also in this case in form of a rib 115 that, once the piece 123 is mounted in the face mask 104, extends along the perimeter edge of the front hollow projection 112 for housing the nose.

In all the embodiments shown in FIGS. 6 to 8B obstruction means divides the internal space 113 in an airtight way into the first zone 116 behind lenses 102, 103 and the second zone 117 including the front hollow projection 112 for housing the nose.

However, in order to avoid fogging up of lenses 102, 103, it is not strictly compulsory for the obstruction means to create a barrier dividing in an airtight way the first zone 116 behind lenses 102, 103 and the second zone 117 including the front hollow projection 112 for housing the nose.

The obstructing means shall at least obstruct a direct flow towards lenses 102, 103 of the air released from the diver nose.

To this end, obstructing means may channel air released from the diver nose towards a channel 125 surrounding lens 102, 103 to allow the flow of air to cool down before reaching the lenses 102, 103.

For instance, in another embodiment obstruction means is located at only the lower part of the perimeter edge of the front hollow projection 112 for housing the nose.

This embodiment is shown in FIG. 9 where obstruction means is interposed between the first zone 116 of the internal space 113 behind lenses 102, 103 and the second zone 117 of the internal space 113 including the front hollow projection 112 for housing the nose and includes for instance wings 126 made of soft and elastically yielding material guiding the flow of air F released from the diver nose towards channels 125 surrounding the upper edge of lens 102, 103.

Of course in a still another embodiment obstruction means is so configured and located to guide the air released from the diver nose towards a channel surrounding lower edge of lens 102, 103.

The diving mask as conceived herein is susceptible of many modifications and variants, all falling within the scope of the inventive concept; furthermore, all the details are replaceable by technically equivalent elements.

The invention claimed is:

1. A diving mask comprising:

a rigid frame, at least one lens, and a face mask, made of soft and elastically yielding material, fixed to said frame, said face mask having a front hollow projection, projecting forwardly relative to the frame, configured to house a nose of a diver, and a rear perimeter profile, projecting rearwardly relative to the frame, applicable in an airtight way to a face of the diver so to delimit an internal space between said mask and the face of the diver, wherein:

an internal surface of said face mask is equipped with an obstruction configured to obstruct a direct flow towards said at least one lens released from the nose of the diver;

the obstruction includes at least one rib projecting rearwardly from a rear face of the internal surface of the face mask; and the obstruction extends along each of opposite sides of the front hollow projection, from an area adjacent to a lower portion of the front hollow projection to at least an area adjacent to an upper portion of the front hollow projection, where the obstruction projects rearwardly a distance from the rear face of the internal surface that gradually increases from the lower portion to the upper portion along each of the opposite sides.

2. The diving mask according to claim 1, wherein said obstruction is interposed between a first zone of said internal space behind said at least one lens and a second zone of said internal space behind said front hollow projection configured to house the nose.

3. The diving mask according to claim 2, wherein said obstruction divides said internal space in an airtight way into said first zone behind said at least one lens and said second zone behind said front hollow projection configured to house the nose.

4. The diving mask according to claim 1, wherein said at least one rib has an apical end, turned back, wherein the apical end is configured to contact a face of a diver, thereby creating a suitable airtight contact with the diver's face.

5. The diving mask according to claim 1, wherein said at least one rib is made of a single piece with said face mask.

6. The diving mask according to claim 1, wherein said at least one rib extends at least in part in a laterally staggered position from said frame.

7. The diving mask according to claim 1, wherein said at least one rib extends at least in part along the perimeter edge of said front hollow projection.

8. The diving mask according to claim 1, wherein said at least one rib has two converging sections connected by a transversal section, said converging sections being configured to be arranged along lateral walls of the nose and said transversal section being configured to be arranged around a root of the nose.

9. The diving mask according to claim 8, wherein said converging sections of said rib are flat.

10. The diving mask according to claim 4, wherein said obstruction is interposed between a first zone of said internal space behind said at least one lens and a second zone of said internal space behind said front hollow projection configured to house the nose, and wherein the apical end is turned back towards an inside of the second zone.

11. The diving mask according to claim 1, wherein the obstruction has two converging sections, each having a flat surface without structural protrusions, each extending in a laterally staggered position relative to the frame, along a perimeter edge of the front hollow projection, the two converging sections connected by a transversal section, the transversal section extending to a rear of a central portion of the frame.

* * * * *